United States Patent [19]

Roerig

[11] 4,272,317

[45] Jun. 9, 1981

[54] ROLL BEARING ALIGNMENT

[75] Inventor: Arnold J. Roerig, Beloit, Wis.

[73] Assignee: Beloit Corporation, Beloit, Wis.

[21] Appl. No.: 90,276

[22] Filed: Nov. 1, 1979

[51] Int. Cl.[3] ..... D21F 3/00; B30B 3/04

[52] U.S. Cl. ..... 162/272; 100/168; 162/358

[58] Field of Search ..... 100/118, 153, 155 R, 100/156, 168, 162 B; 162/358, 273, 360 R, 360 DP, 199, 200, 272; 29/116 AD

[56] References Cited

U.S. PATENT DOCUMENTS

| | | | |
|---|---|---|---|
| 1,925,972 | 9/1933 | Standley et al. | 162/360 R |
| 3,783,097 | 1/1974 | Justus | 162/358 |
| 3,856,462 | 12/1974 | Mueller | 100/168 |
| 4,140,575 | 2/1979 | Wenzl | 162/273 |
| 4,201,624 | 5/1980 | Mohr et al. | 162/360 R |

*Primary Examiner*—Peter Chin

*Attorney, Agent, or Firm*—Hill, Van Santen, Steadman, Chiara & Simpson

[57] ABSTRACT

An extended press nip for a paper making machine including a large main roll with end bearings, a pressure shoe having a concave face defining an extending press nip with the roll, an overhead looped felt passing through the nip, a lower looped belt passing through the nip, means lubricating the belt surface facing the shoe, and pivotal supports for the end bearings for the roll with one support being a single pivot and the other support being a double pivoted link and the bearings additionally supported on dowels which accommodate alignment of the bearings.

10 Claims, 4 Drawing Figures

ROLL BEARING ALIGNMENT

BACKGROUND OF THE INVENTION

The present invention relates to improvements in paper making machines, and more particularly to an improved structure for an extended press nip which permits alignment of the roll and insures continuous self-alignment of the bearings for the main roll.

In a commercial high speed paper making machine for making various types of paper, the paper web is formed and passes through a press section for mechanical extraction of the water and thereafter passes through a dryer section for thermal extraction of the water. A substantial improvement in the press section has been obtained by the provision of extended nip presses which, instead of simply employing two opposed rolls, employ a structure where the web is subjected to a continual pressure for a period of time. One commercially satisfactory arrangement of this type of structure employs a large press roll with an opposed facing concave shoe. A tough belt passes through the nip between the roll and shoe and a paper web carried on a felt is taken through the nip with the water pressed from the web and into the felt during the travel through the nip.

In this type of construction, it is essential to be able to align the large roll and the shoe to bring them into perfect alignment for uniform pressing and for extended wear of the parts. The large roll is carried on end support bearings which must support the pressure of the press and these bearings must be kept in alignment with the roll end journals if satisfactory operation and wear is to be achieved. In addition to the misalignment problems of the bearings caused by shifting of the roll into alignment, the spacing between the ends of the bearings changes as the roll bends, and also changes as the temperature of the roll changes. These changes also tend to cause misalignment.

It is accordingly an object of the present invention to provide an improved extended nip roll structure wherein the problem of misalignment of the bearings at the end of the roll is avoided.

Another object of the invention is to provide an improved extended nip press wherein environmental circumstances such as change in temperature of the main roll and bending of the main roll do not cause bearing misalignment problems.

A further overall objective is to provide an improved extended nip press which has improved longer wearing bearing life eliminating the need for rapid replacement of bearings and journals.

Other objects, advantages and features, as well as equivalent structures which are intended to be covered herein, will become apparent with the teaching of the principles of the present invention in connection with the disclosure of the preferred embodiment in the specification, claims and drawings, in which:

DRAWINGS

DESCRIPTION

Figure 1:
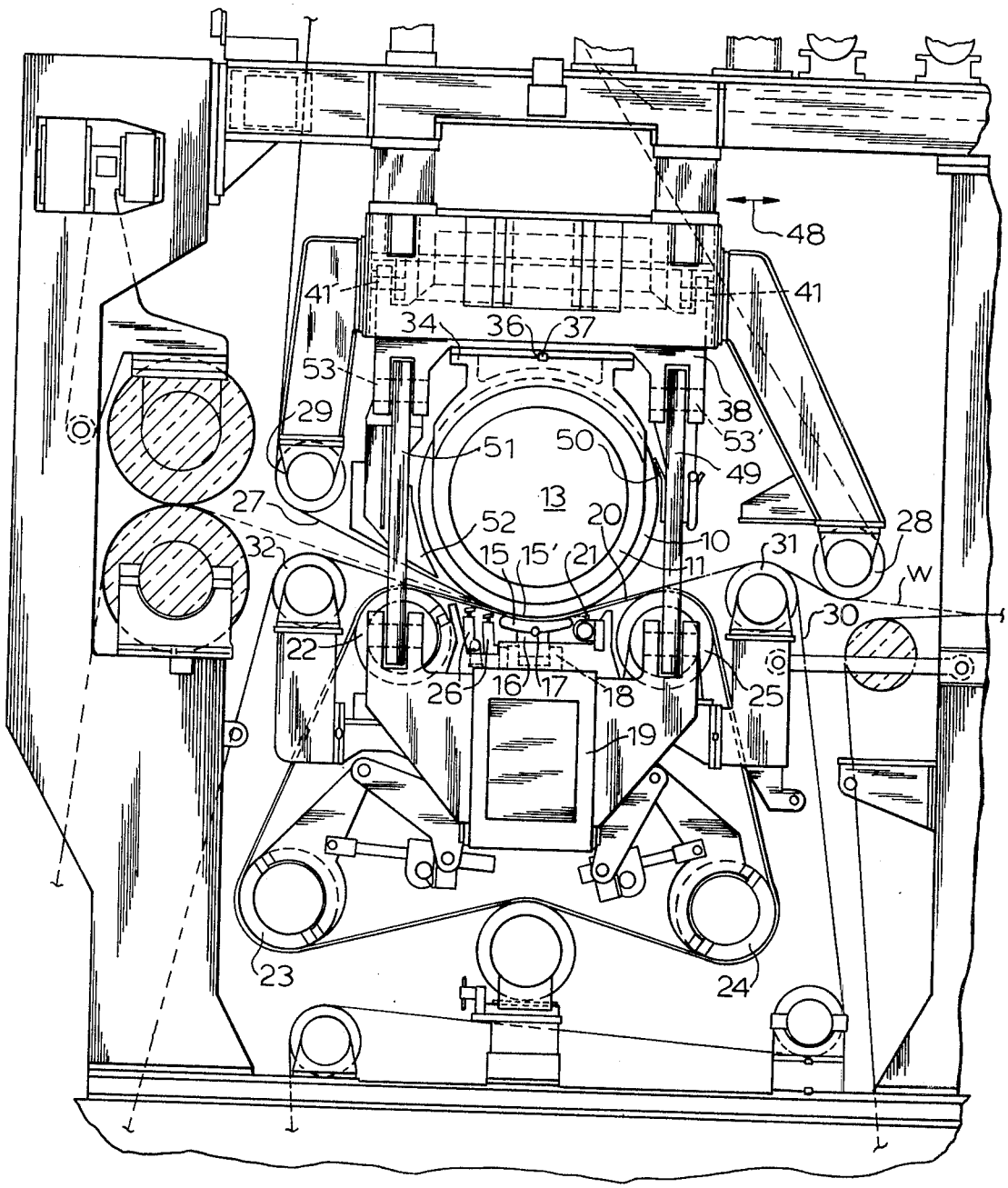
FIG. 1 is a front view of a press section of a paper making machine taken in a machine direction of a structure constructed and operating in accordance with the principles of the present invention.
Figure 4:
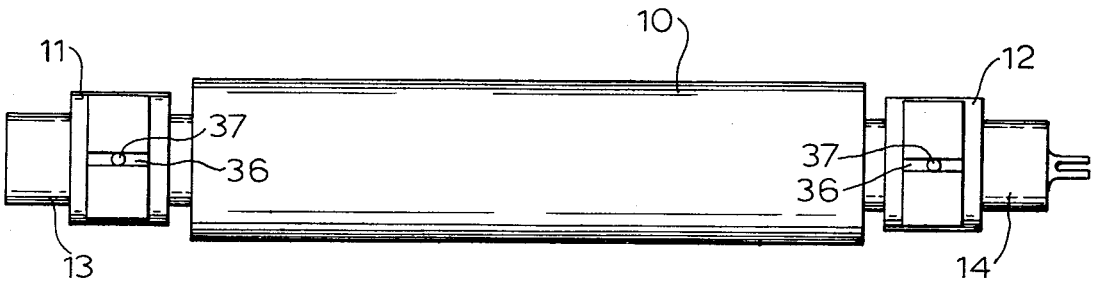
FIG. 4 is a plan sectional view taken substantially along line IV—IV of FIG. 2.

As shown principally in FIG. 1, the extended nip press of the drawings includes a main roll 10. The main roll is supported in end bearings 11 and 12 of FIG. 2, which carry the journals 13 and 14 at the roll ends.

Below the main roll 10 is an opposing press shoe 15. The shoe has a concave upper surface 15'', facing the roll 10, and the shoe is pivotally supported on a roll pin 17 carried in a piston 16. The piston 16 is mounted in an elongate groove 18 with liquid under pressure being forced into the groove to urge the piston upwardly. The shoe and its carrying mechanism are supported in a lower frame 19.

At the lead end of the shoe, its tip is relieved, and liquid is supplied by a lubricating supply mechanism 21 to reduce friction between the concave surface 15 of the shoe and a looped pressure belt 20. The belt is carried under tension on rolls 22, 23, 24 and 25, at least one of which are driven to cause the belt to move through the nip which is formed between the shoe and roll, at the speed of travel of the web. The roll is also driven by a mechanism, not shown, at the speed of web travel with the web being shown at W, in broken lines.

Following the nip are doctors 26 within the belt for removing the lubricating liquid supplied by the liquid supply mechanism 21.

At least one liquid receiving member passes through the nip with the web, and as shown, the web is carried between an upper felt 27, and a lower felt 30.

The lower felt is supported on rolls 31 and 32. Additional rolls will, of course, be provided to support the felt which is in the form of a loop.

The upper felt is also supported on felt guide rolls with rolls 28 and 29 being shown.

The web arrives from the forming section of the machine and may pass through additional press nips before arriving at the extended press shown, with the web traveling from right to left as shown in FIG. 1.

The bearings at the ends of the roll have flanges as shown at 34 and 35 for bolting the bearings to the end links for pivotal supports 38 and 39. For alignment of the end bearings as the roll is aligned transversely of the web, vertical dowels pass upwardly from the end bearings 11 and 12 into the respective links 38 and 39, and bolts (not shown) extending through flanges 34 and 35 will accommodate the alignment.

Figure 2:
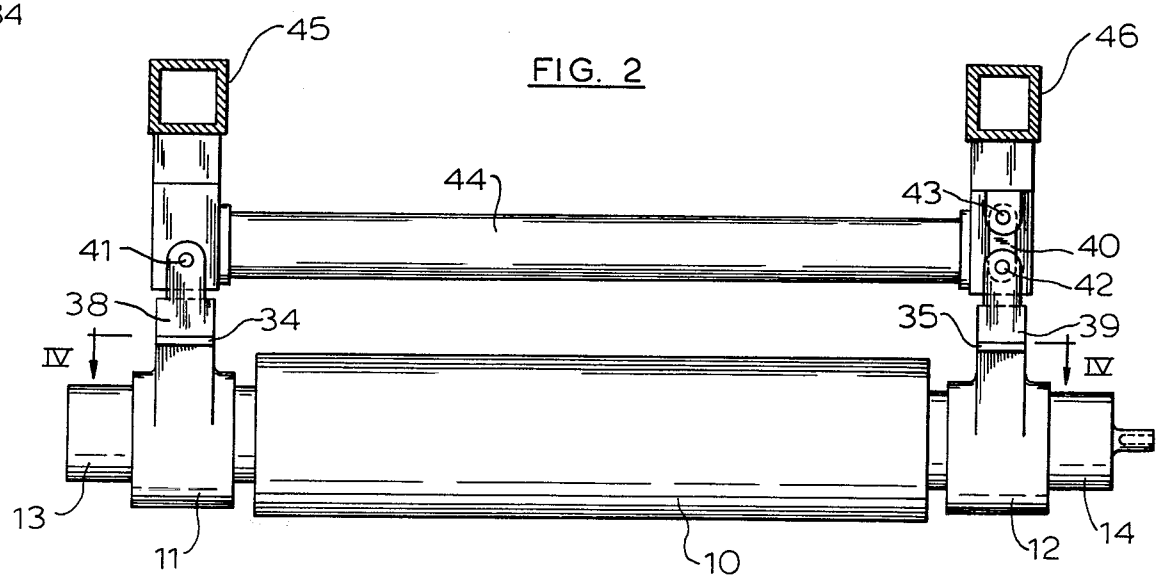
FIG. 2 is a cross machine direction view with portions removed for clarity of a support for the press roll as shown in FIG. 1.
Figure 3:
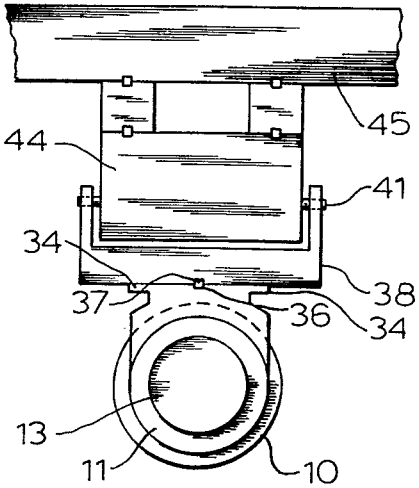
FIG. 3 is an end elevational view shown in somewhat schematic form of the roll structure of FIG. 2.

The links 38 and 39 are constructed so as to be freely pivotally supported. As shown in FIG. 2, the link 38 is supported on a pivot 41 extending in the machine direction with the pivot being supported on the frame 44. The frame extends rigidly along the length of the roll and has side frame members 45 and 46. At erection, the side frame members are adjustable in the machine direction, as shown schematically by the arrowed line 48 in FIG. 1, to align the roll.

The link 39 at one end of the roll is pivotally carried at 42 which connects to an upper link 40 pivoted to the frame at 43, FIG. 2. The free pivotal support of the links allow the roll to deflect without misaligning the bearings. As the roll deflects and the bearings housings 11 and 12 pivot, there is a cross-machine displacement of the bearings, i.e., a shortening of the distance between them. There is also a tilting of the bearings with the journals at the roll ends. To compensate for this displacement and tilting, the links 38 and 39 pivot to permit bearing alignment and and to permit displacement in the cross-machine direction. The link 39 and the upper link 40 accommodate this movement. The double link arrangement including the lower link 39 and the upper link 40 also provides means for cross machine thermal expansion of the roll and eliminates the need to provide for thermal expansion in the bearing housing. The structure and method illustrated provides a strong and mechanically sound and uncomplicated long wearing arrangement for supporting the bearings and providing for misalignment. The center dowels which are provided as shown at 37 in the key ways 36 align the roll in the machine direction, but still allow the housings to be aligned to the roll journals. The self-alignment feature allows the roll bearings to have a large capacity, and eliminates reaction loads on the frame due to misalignment.

The upper link 38 as shown in FIG. 1 is arranged so that it will also carry the ends of mechanism associated with operation of the roll 10. Similar supports are provided at the link 39 at the other end of the roll. As shown in FIG. 1, an arm 49 pivoted at 53' and another arm 51 pivoted at 53 carries the lower frame 19.

Links 38 and 39 carry a doctor 50 for the roll. Frame 44 carries a saveall arrangement 52.

Thus, it will be seen that I have provided an improved extended nip press arrangement and a means for supporting the main roll which attains long operating life and eliminates wear inducing loads which would cause the need of frequent attention and servicing.

I claim as my invention:

1. An extended nip press for a paper making machine comprising in combination:

a main roll having end bearings at the roll ends;

a pressure shoe having a concave face defining an extended press nip with the roll;

means guiding a felt to pass through the nip receiving water expressed from a traveling web passing through the nip in a machine direction;

a looped belt passing through the nip between the shoe and web;

and a free pivot support for at least one of said end bearings enabling pivotal movement thereof in the cross-machine direction for accommodating effective changes in distances between said end bearings due to bending and temperature change of the roll.

2. An extended nip for a paper making machine constructed in accordance with claim 1:

wherein a support is provided for each of said end bearings pivoted about an axis extending in the machine direction.

3. An extended nip for a paper making machine constructed in accordance with claim 1:

wherein said end bearing support includes a pivotal link having a first pivot supported on a frame and a second pivot connected to said bearing.

4. An extended nip press for a paper making machine comprising in combination:

a main roll having end bearings at the roll ends;

a pressure shoe having a concave face defining an extended press nip with the roll;

means guiding a felt to pass through the nip receiving water expressed from a traveling web passing through the nip in a machine direction;

a looped belt passing through the nip between the shoe and web; and said end bearings mounted on freely pivotal support means having pivots enabling pivotal movement of said bearings in the cross-machine direction for accommodating effective bearing displacements due to bending and temperature change of the roll.

5. An extended nip for a paper making machine constructed in accordance with claim 4:

wherein the support means for the bearings carry additional supports pivotally mounted about an axis extending in the machine direction and connected to carry said shoe.

6. An extended nip for a paper making machine constructed in accordance with claim 4:

wherein said end bearing support means includes a pivotal link for one of said bearings with said pivotal link having a first pivot supported on a frame and a second pivot connected to said bearing.

7. An extended nip for a paper making machine constructed in accordance with claim 4:

wherein said support means for the end bearings are mounted on a frame which extends rigidly along the length of the roll.

8. An extended nip for a paper making machine constructed in accordance with claim 4:

wherein said end bearing support means are mounted on a frame, said frame having movable members adjustable to individually adjust the end bearing support means in a machine direction for alignment of the roll.

9. An extended nip for a paper making machine constructed in accordance with claim 6:

and including an overhead frame carrying said support means for the end bearings with the supports and roll depending vertically downwardly from the frame.

10. An extended nip for a paper making machine constructed in accordance with claim 4:

including an overhead frame, and where the end bearing support means are at each end of the roll with the support at one end being pivotally supported about an axis extending in the machine direction and the support at the other end including a pivotal link supported about a first pivot connected to the frame and a second pivot connected to the bearing with said pivots pivoting about an axis extending in the machine direction with said pivots spaced apart in the machine direction so as to provide machine direction support for the roll.

* * * * *